US005191840A

United States Patent [19]

Cotic et al.

[11] Patent Number: 5,191,840

[45] Date of Patent: Mar. 9, 1993

[54] SPIKE DRIVING MACHINE HAVING PUSHING AND PERCUSSIVE SPIKE DRIVING FUNCTIONS

[75] Inventors: Dennis J. Cotic; Jack K. Hosking, both of Waukesha, Wis.

[73] Assignee: Oak Industries, Inc., Waltham, Mass.

[21] Appl. No.: 758,902

[22] Filed: Sep. 11, 1991

[51] Int. Cl.[5] ..... E01B 29/26

[52] U.S. Cl. ..... 104/17.1; 173/149

[58] Field of Search ..... 104/17.1; 173/149, 152; 227/110, 111

[56] References Cited

U.S. PATENT DOCUMENTS

| | | | |
|---|---|---|---|
| 3,120,195 | 2/1964 | McWilliams | 104/17.1 |
| 3,139,944 | 7/1964 | Smith | 173/152 |
| 3,257,962 | 6/1966 | Doorley et al. | 104/17.1 |
| 3,426,698 | 2/1969 | Foxx et al. | 104/17.1 |
| 4,273,052 | 6/1981 | Woolner et al. | 104/17.1 |
| 4,409,902 | 10/1983 | Frank | 104/17.1 |
| 4,579,061 | 4/1986 | Dieringer | 104/17.1 |
| 4,777,885 | 10/1988 | Dieringer | 104/17.1 |
| 4,782,989 | 11/1988 | Wallin et al. | 227/110 |

*Primary Examiner*—Robert J. Oberleitner
*Assistant Examiner*—S. Joseph Morano
*Attorney, Agent, or Firm*—Welsh & Katz, Ltd.

[57] ABSTRACT

A machine for driving spikes into the ties of a railroad track includes a spike driving assembly movably disposed relative to a frame for gripping spikes and driving gripped spikes into the ties, the spike driving assembly having a spike pushing function and a spike percussive function. In the pushing function the spike driving assembly pushes the spike a specified distance into the tie by the application of constant pressure, and in the percussive function the driving assembly percussively completes the driving of the spike into the tie. An operator may selectively alternate between the pushing and percussive functions.

26 Claims, 6 Drawing Sheets

DRIVING POSITION

UP POSITION

READY POSITION

SPIKE DRIVING MACHINE HAVING PUSHING AND PERCUSSIVE SPIKE DRIVING FUNCTIONS

BACKGROUND OF THE INVENTION

The present invention is related to machines used in performing railway right-of-way maintenance, and specifically to a machine for driving railroad spikes into railroad track ties using pushing and/or percussive forces.

Conventional railroad spike driving machines are commonly provided in one of two configurations. The first configuration, referred to as a pusher type spiker, includes a hydraulic ram used for pushing the individual spikes into the railroad tie under constant pressure. The second configuration, referred to as a percussive type spiker, involves a percussive system which uses a vertically reciprocating hammer to drive the spike by repeated blows.

Both the pusher and percussive configurations have specific advantages and disadvantages. While the push type spiker is capable of driving relatively more spikes per minute than the percussive type spiker, the latter is more effective in driving spikes in difficult applications.

Instances where the percussive type spiker is more effective include track sections where the ties are made of relatively hard wood, or where recycled spikes are being used to refurbish the rail bed. Recycled spikes often include bent spikes, which, if driven by a push type spiker, may be bent more severely. The relatively greater amount of driving force applied by the percussive type spiker avoids this unwanted additional bending of the spikes, and also drives spikes farther into the tie than is possible with push type spikers. Also, the push type spiker is significantly quieter than the percussive type machine, and as such is more desirable from the operator's perspective, especially in view of the fact that spike driving machines are operated for extended periods of time.

An object of the present invention is to provide a rail spike driver or spiker machine having the capability to drive spikes using both the pusher and percussive functions.

Another object of the present invention is to provide a combination push/percussive spiker in which both functions are performed by a single unit.

Yet another object of the present invention is to provide a combination push/percussive spiker which features selectable variability between pushing and percussing functions.

An additional object of the present invention is to provide a combination push/percussive spiker which is compatible with existing spike driving equipment.

SUMMARY OF THE INVENTION

Accordingly, the above-listed objects are achieved by the present invention, which provides a railway right-of-way maintenance machine including a spike driving assembly having a spike pushing function and a spike percussing function. Preferably, both functions are embodied in a single unit or spiker gun. In the pushing function, the spike driving assembly pushes the spike a specified distance into the tie by the application of constant pressure, and in the percussing function preferably performed at the end of the driving cycle, percussively drives of the spike into the tie. The present spike driving machine may be operated in either automatic or manual modes. In the automatic mode, a pressure sensitive control system automatically converts from pushing to percussing. In the manual mode, the machine operator controls if and when the spiker converts from pushing to percussing or vice versa. If desired, the machine can perform either function exclusively, or a selected, variable alternating sequences of the two functions.

More specifically, the present machine for performing an operation on spikes of a railroad track having a plurality of ties includes a frame having a plurality of wheels for rotatably engaging the railroad track, a drive system for driving the frame along the track, and a spike driving assembly movably disposed relative to the frame for gripping spikes and driving gripped spikes into the ties, the spike driving assembly having a pushing function and a percussive function. In the preferred embodiment, the spike driving assembly includes a spiker gun incorporating a hydraulic impact hammer which is reciprocally vertically movable in the manner of a hydraulic ram used in a conventional push type spiker.

In addition, the invention provides a method for driving spikes into the ties of a railroad track, including providing a spike to a spike driving device for driving spikes, gripping the spike on the spike driving device, actuating the spike driving device to perform a first function to the spike, and signalling the spike driving device to cease performing the first function and begin performing a second function to the spike for driving the spike into the tie.

DESCRIPTION OF THE PREFERRED EMBODIMENT

Figure 1:
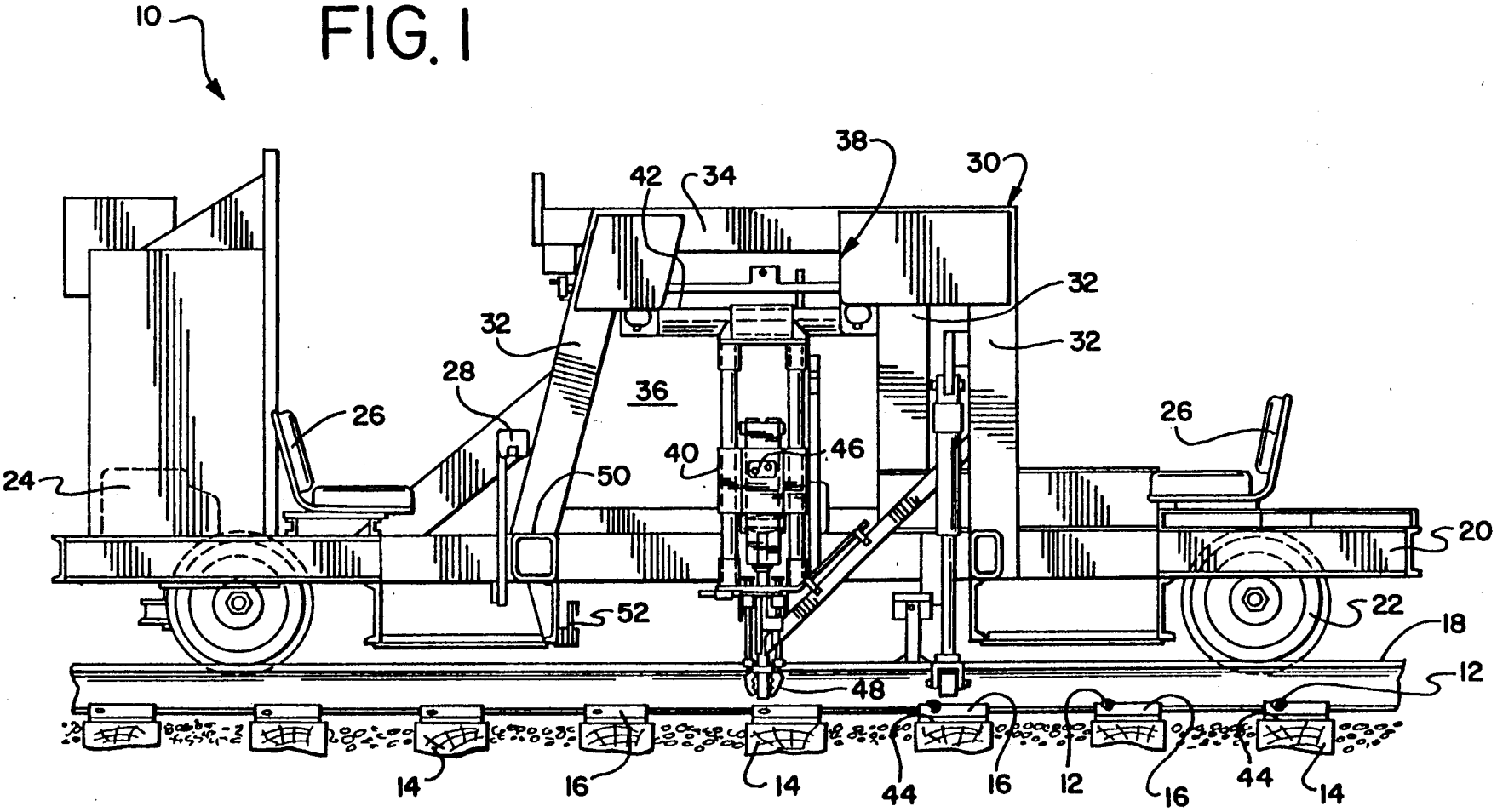
FIG. 1 is a side elevational view of a spike driving machine embodying the present invention.
Figure 3:
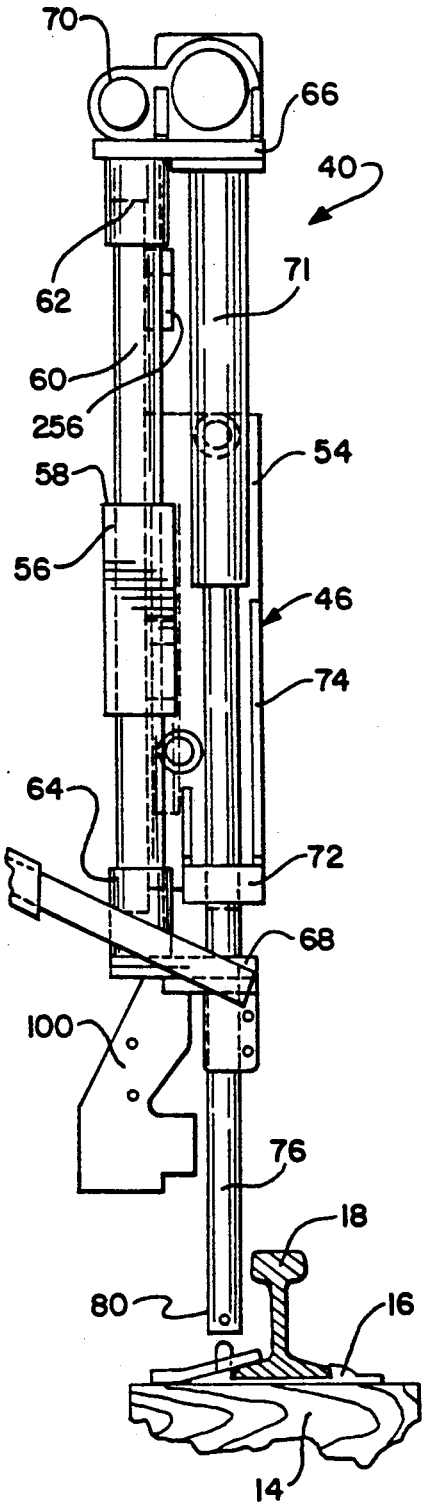
FIG. 3 is a side elevational view of the spike driving assembly of FIG. 2, with portions deleted for clarity.
Figure 2:
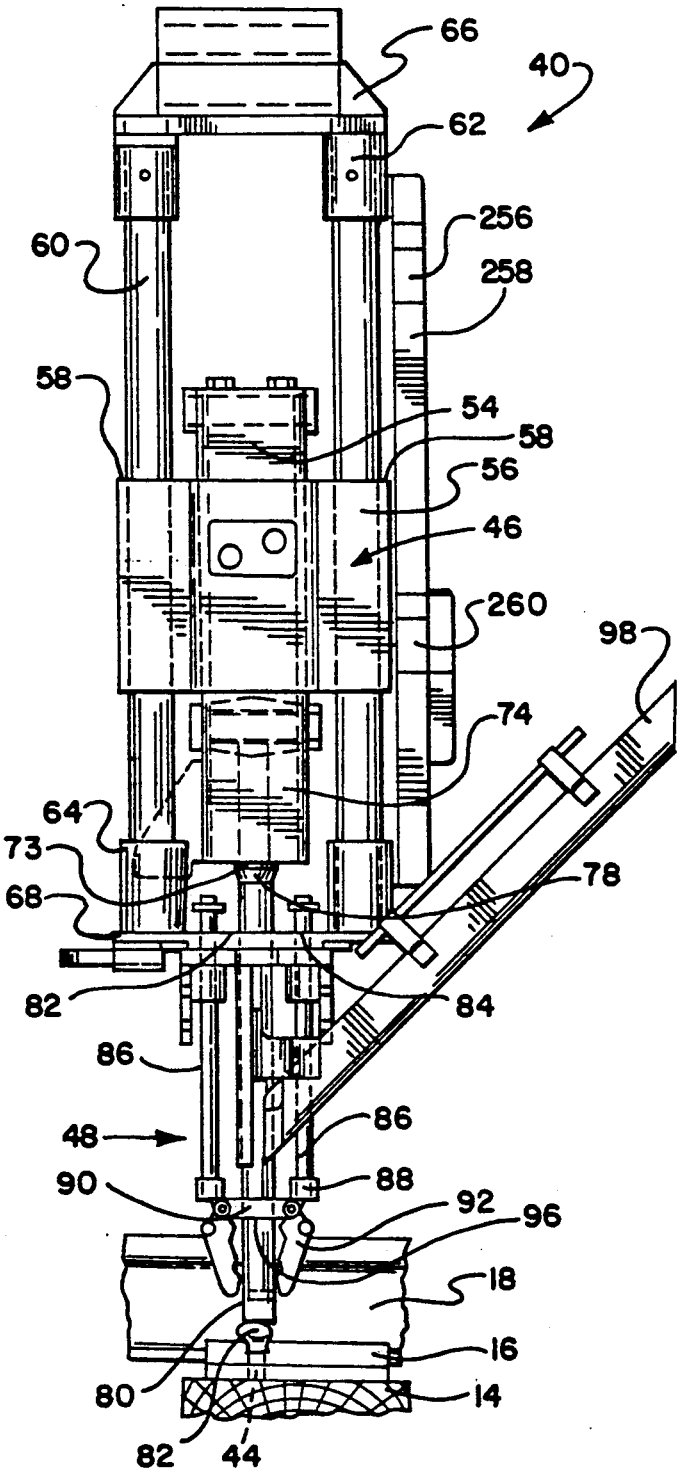
FIG. 2 is a front elevational view of the spike driving assembly of the present invention, depicted in the driving position.
Figure 4:
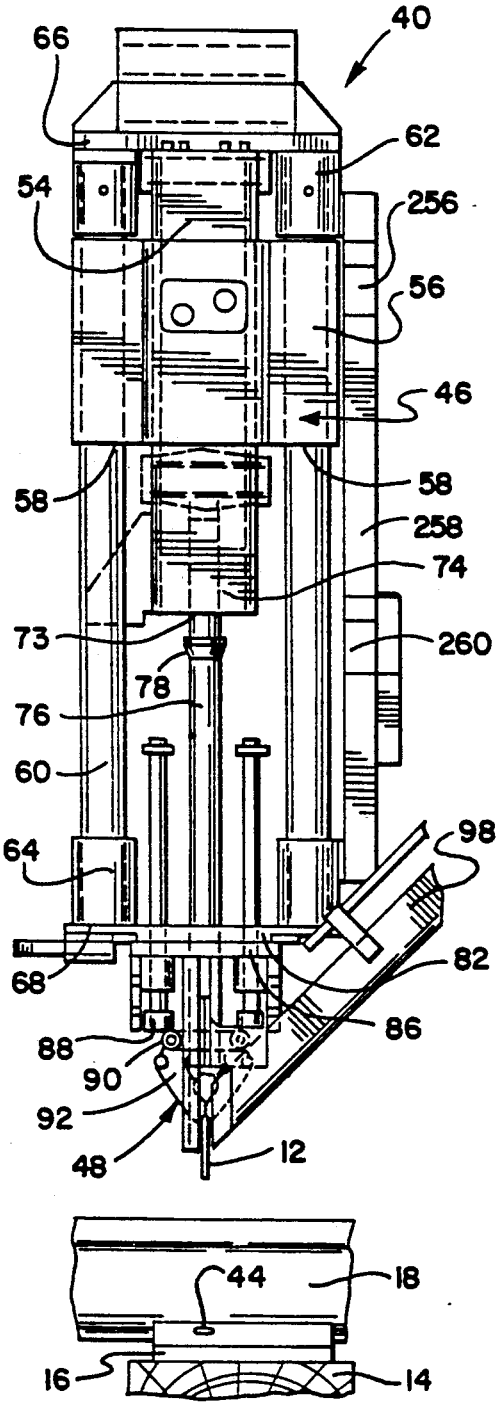
FIG. 4 is a front elevational view of the spike driving assembly of FIG. 2 depicted in the up position.
Figure 5:
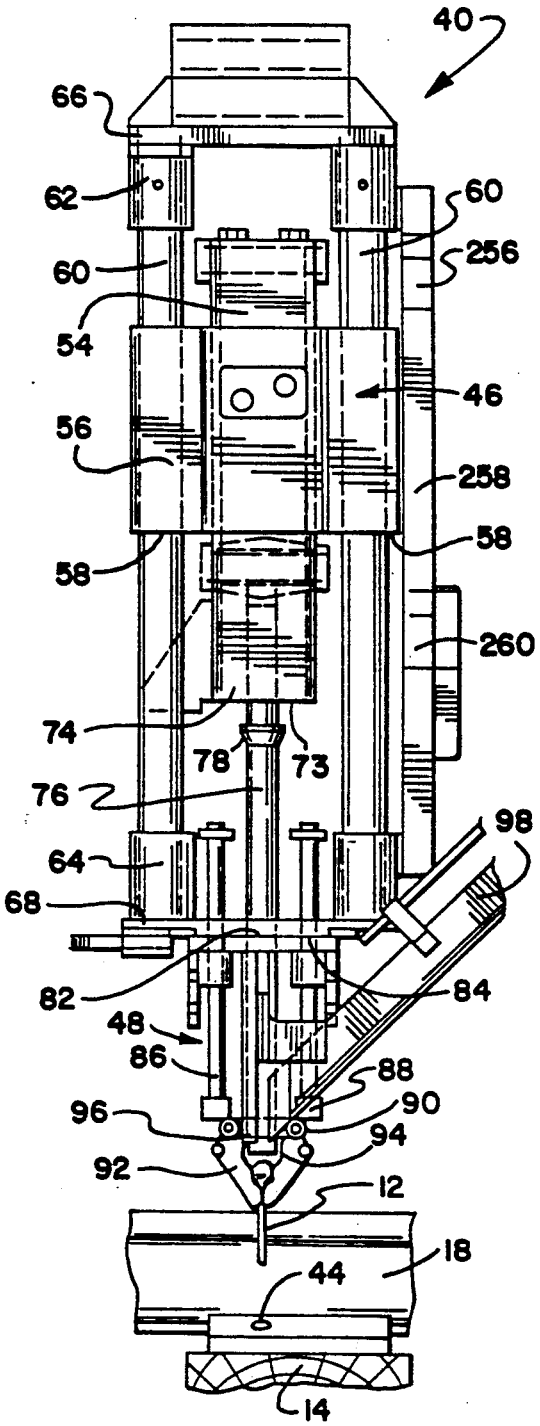
FIG. 5 is a front elevational view of the spike driving assembly of FIG. 4 depicted in the ready position.

Referring now to FIG. 1, the spike driving machine of the invention is generally indicated at 10 and is designed to drive railroad spikes 12 into railroad ties 14 to secure tie plates 16 and usually a pair of rails 18 to the ties. The machine 10 includes a frame 20 supported on wheels 22 such that the frame can be driven along the rails 18 of a railroad track. The frame 20 supports a source of motive power 24 (shown hidden) such as an internal combustion engine, and a pair of operator's seats 26. At least one of the operator's seats 26 is provided with a control joystick 28 having at least one trigger or other functional controls such as buttons (not shown).

A centrally located, elevated portion 30 of the frame 20 is supported by generally vertical columns 32 which are joined at their respective upper ends by horizontal beams 34 to define a generally box-shaped operational zone 36. The operational zone 36 is the area within which a spike driving assembly, generally indicated at 38, is suspended for driving spikes 12 into the railroad ties 14.

The spike driving assembly 38 includes at least one, and preferably four spike driving units 40 which are commonly referred to as spiker guns. For purposes of clarity, only one such gun 40 is depicted in FIG. 1. Each gun 40 is suspended from the elevated portion 30 of the frame 20 in a known manner by a carriage 42 which enables the gun to be adjustably positioned with respect to the frame 20 for proper alignment of the gripped spike 12 into a selected hole 44 in the tie plate 16. Normally, tie plates 16 have several such holes 44 into which spikes 12 are inserted for securing the rails 18 to the ties 14. Each gun 40 also includes a hydraulic ram portion 46 for driving the spikes 12, and a gripping portion 48 adapted for gripping a spike so that it can be properly aligned over the hole 44 and accurately driven into the tie at that point.

A transverse frame member 50 is secured to the frame 20 to extend perpendicularly to the direction of movement of the machine 10. One end of the frame member 50 is preferably positioned over one of the rails 18 adjacent the spike driving assembly 38, and the other end of the member 50 is positioned over the other rail. A gripping assembly 52 is secured to the frame member 50 for clamping the machine 10 to the rails 18 while the machine drives spikes 12 into the ties 14. Without such a gripping assembly 52, the force of the spike driver gun 40 driving a spike would also tend to lift the machine 10 off of the rail 18. Various configurations of rail gripping assemblies are known, and a suitable rail gripping assembly 52 is disclosed in commonly assigned U.S. Pat. No. 4,579,061, which is incorporated by reference herein.

Referring now to FIGS. 2-5, the spiker gun 40 of the present invention is shown in greater detail. While conventional pusher type spikers employ a hydraulic cylinder having a downwardly extending piston configured for engaging the head of the spike, the present invention employs the hydraulic ram 46 including a hydraulic impact hammer 54 of the type conventionally used for breaking up concrete or asphalt pavement. Although several such hammers are commercially available, a preferred hammer is the HY-RAM ® brand Model 700, manufactured by Allied Steel and Tractor Products, Solon, Ohio. The HY-RAM Model 700 is designed to deliver 200 ft. lbs. of impact energy at a rate of 450-1200 blows per minute.

The hammer 54 is attached to a hammer mounting bracket 56 having a pair of vertically extending sleeves 58. The sleeves 58 are each dimensioned to slidingly engage a corresponding vertical carriage shaft 60. Corresponding upper and lower ends of the shafts 60 are secured within upper and lower sockets 62, 64 which are respectively located on fixed upper and lower brackets 66, 68 of the gun 40. A hydraulic pump 70 (best seen in FIG. 9) supplies pressurized fluid to a double-acting hydraulic cylinder 71 (best seen in FIG. 3) which is used to reciprocally move the hammer 54 and the hammer mounting bracket 56 vertically relative to the shafts 60. The cylinder 71 is connected between the upper bracket 66 and a tab 72 located on the hammer mounting bracket 56.

Figure 8:
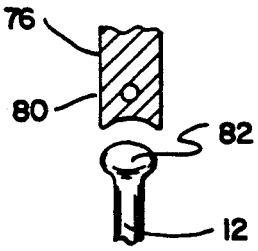
FIG. 8 is a fragmentary sectional view of the anvil of the present spike driving assembly shown adjacent a spike head.

A lower opening 73 in a hammer housing 74 defines a passageway for a shaft-like anvil 76. The hammer 54, hammer mounting bracket 56, the tab 72 and the hammer housing 74 are preferably assembled as a single piece. The anvil 76 includes a flared ring 78 which serves as a stop, limiting the upward travel of the anvil 76 against the hammer housing 74 during percussing. A lower end 80 of the anvil 76 is configured to matingly engage the head 82 of a spike 12 (best seen in FIG. 8). In the preferred embodiment, the end 80 is concave in shape.

The gripping portion 48 of the spiker gun 40 has at its upper end the lower bracket 68, which defines a large central throughbore 82 for the passage of the anvil 76. In the preferred embodiment, the throughbore 82 is circular in shape, however other shapes are contemplated. Also included in the lower bracket 68 is a plurality of relatively smaller throughbores 84 disposed for the reciprocal vertical slidable passage of a like plurality of guide rods 86, which guide the vertical movement of the gripping portion 48. Preferably two throughbores 84 are provided for the accommodation of two guide rods 86 for each gun 40.

A lower end of each of the guide rods 86 matingly engages a corresponding socket 88 in a jaw bracket 90. A pair of spike gripping jaws 92 are mounted to the bracket 90 in opposed relationship to grasp a spike 12. The jaws 92 are biased toward the closed or gripping position by at least one coiled spring 94 (best seen in FIG. 5). The jaw bracket 90 also defines a central opening 96 through which the anvil 76 passes to separate the jaws 92 and push the spike 12 into the tie 14 (best seen in FIG. 2). A spike magazine 98 feeds aligned spikes to the jaws 92 in a manner well known to skilled practitioners, and employs a hydraulically operated, reciprocating feeder tongue 100 (best seen in FIG. 3) to feed spikes 12 into the jaws 92.

Figure 6:
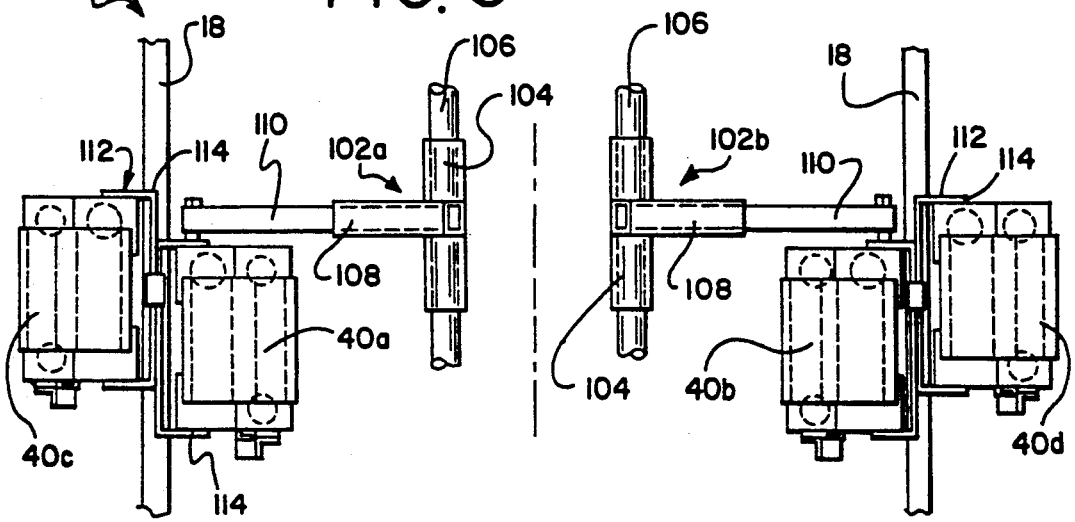
FIG. 6 is a fragmentary overhead plan view of the spike driving assembly stabilizing structure of the machine of FIG. 1.

Referring now to FIG. 6, a common design consideration of spike driver machines is that the position of the spiker guns, and particularly the gripping portion 48, must be maintained relative to the tie plate 16 to ensure accurate positioning of the spike 12 in the holes 44 of the tie plate. A preferred spiker gun stabilizer is disclosed in commonly assigned U.S. Pat. No. 4,777,885, which is incorporated by reference herein. However, other stabilizer configurations may be suitable for the present invention. In conventional spike driver machines, a stabilizer is provided to each gun.

In the present invention, two such gun stabilizers 102*a*, 102*b* are provided, and are connected to a corresponding gun 40*a* and 40*b*. The stabilizers 102*a* and 102*b* generally include a cylindrical sleeve 104 which slidably engages a shaft 106 fixed to the frame 20. Each stabilizer 102 has a telescoping shell 108 secured perpendicularly to the sleeve 104 in which an elongate member 110 telescopes under the control of a braking mechanism. The member 110 is pivotally attached to the corresponding gun 40.

In order to minimize material costs and assembly time, instead of providing a stabilizer 102 for each gun 40, the present invention includes a supplemental gun mounting bracket 112 by which adjacent guns are releasably secured to each other. Specifically, gun 40*c* is stabilized by gun 40*a*, and gun 40*d* is stabilized by gun 40*b*. The bracket 112 includes a pair of C-shaped members 114 releasably fixed to each other in back-to-back relationship, with one member 114 being horizontally offset relative to the adjacent member. This offset positioning orients the adjacent guns 40 on either side of the corresponding rail 18 to be in the optimal position for alignment of the guns over the holes 44 in the tie plates 16. At the same time, the stabilizing action of the stabilizer 102 has been found to be adequate to sufficiently stabilize the adjacent gun pairs 40*a*/40*c* and 40*d*/40*d*.

Figure 7:
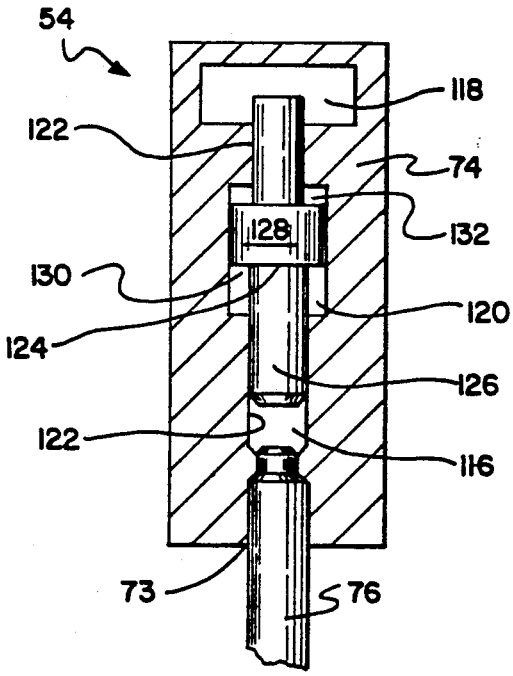
FIG. 7 is a diagrammatic sectional view through the hydraulic impact hammer of the type used in the present invention.

Referring now to FIG. 7, the structural details of the impact hammer 54 are illustrated. In the interior of the housing 74, a central chamber 116 is defined, and includes an upper accumulator chamber 118 which is filled with pressurized gas, such as nitrogen. The chamber 118 is in communication with a high/low pressure chamber 120 by a generally vertically oriented piston track 122. A piston 124 having an elongate shank 126 and a radially extending collar 128 reciprocally slides within the track 122, with the collar located in the high/low pressure chamber 120. A lower portion 130 of the chamber 120 is subject to constant high hydraulic pressure, while an upper portion 132 of the chamber 120 is subject to alternating high and low hydraulic pressure.

When the hammer 54 is in operation, changes in pressure are achieved through valving and porting, depending on the position of the piston 124. When the upper portion 132 of the chamber 120 is connected to low pressure, the high pressure in the chamber 130 causes the piston 124 to rise upward in the track 122, which compresses the gas in the accumulator chamber 118. At the top of the stroke of the piston 124, a hammer main valve shifts, directing high pressure into the upper portion 132 of chamber 120. The greater area of the portion 132, relative to the portion 130, combined with the gas pressure in the accumulator chamber 118 which is directed against the piston 124, drives the piston downward, delivering impact to the anvil 76. The hammer main valve then shifts again, connecting portion 132 to tank, and the cycle is repeated.

Figure 9:
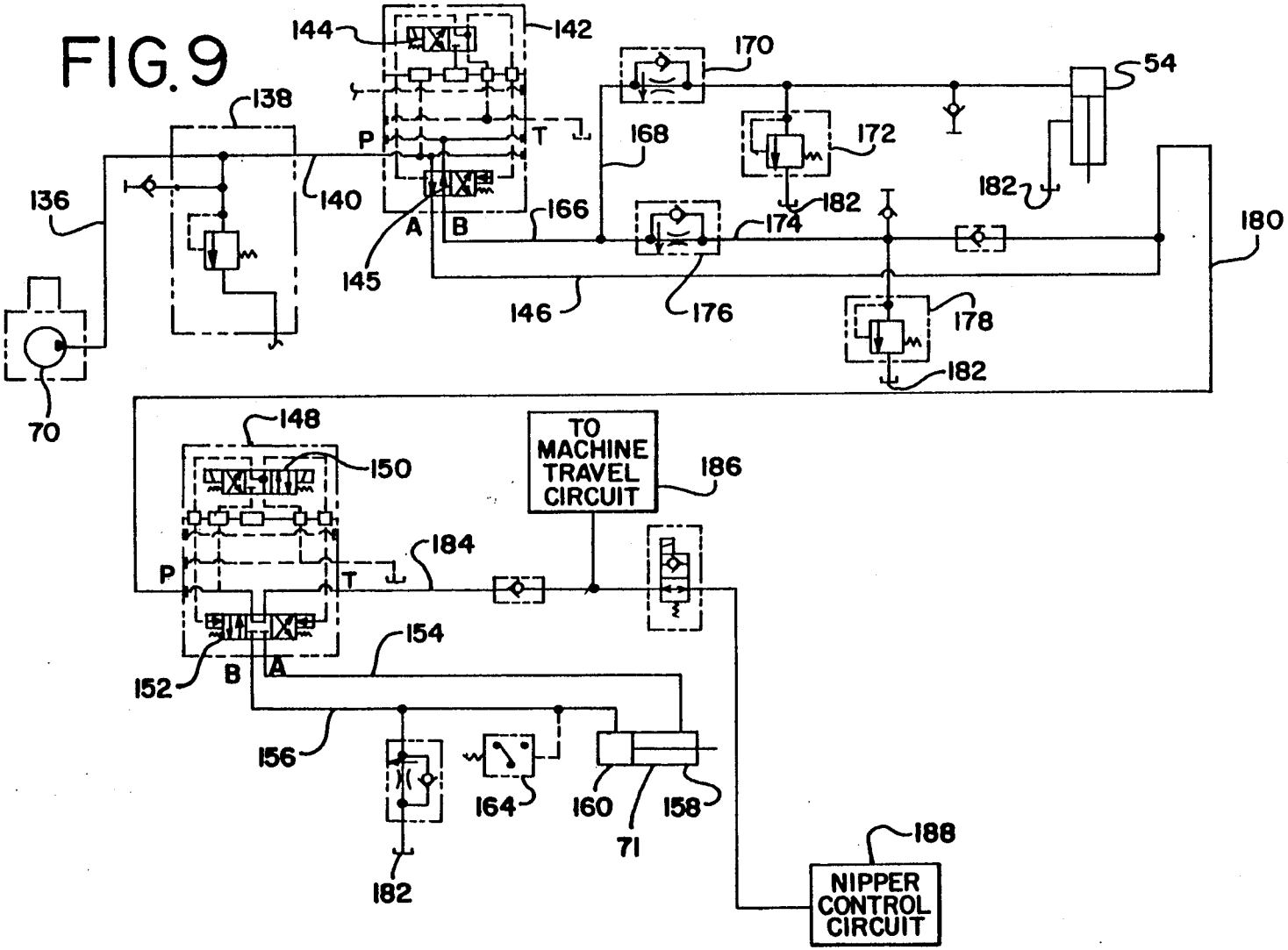
FIG. 9 is a schematic of the hydraulic circuit system of the present spike driving assembly.

Referring now to FIG. 9, the hydraulic circuitry for a single gun 40 is disclosed, and it will be appreciated that the circuitry for the machine 10 will include four such circuits. The pump 70 introduces fluid through line 136 to a relief valve 138, which is preferably set at 2100 psi. A line 140 connects the relief valve 138 with the hammer main valve 142, the operation of which was discussed in relation to FIG. 7. The valve 142 is a solenoid controlled, pilot operated, directional control valve, and a suitable model is distributed by Racine Hydraulics, Racine, Wis., under Model No. MD 12PE-NA-AA-12VD). The valve 142 includes a pair of four-way, two position, pilot pressure operated valve spindles 144, 145, which, when in the normal operating (closed port and parallel port, respectively) positions depicted in FIG. 9, hydraulic fluid flows through line 146 to a driving valve 148, which is a solenoid controlled, pilot operated, directional control valve, having a pair of four-way, three position valve spindles, 150, 152 which control the raising and lowering of the gun 40 on the carriage shafts 60. A suitable model is distributed by Racine Hydraulics, Racine, Wis., under Model No. MD-12SANC-AD-12V. In the closed center port position of the spindle 152 shown in FIG. 9, the gun 40 would be immobile.

Hydraulic lines 154 and 156, which are the respective A and B lines of the spindle 152, are connected to the rod and blind ends, 158, 160, respectively of the double acting hydraulic cylinder 71 to achieve the vertical movement of the gun 40 on the carriage shafts 60. When the spindle 152 is moved to the right, to the parallel port position, hydraulic fluid flows through line 156, to pressurize the blind end 160, to drain the rod end 158 to tank, and begin the lowering of the gun 40. In this manner, the push function of the machine 10 is carried out.

When the machine 10 is set in an automatic mode, the resistance encountered by the anvil 76 in driving the spike 12 will increase the pressure in the blind end 160. When a variable predetermined pressure is reached in the blind end 160, a pressure switch 164, which is indirectly connected to the hammer main valve 142, actuates the spindles 144, 145 to the cross port positions to change the gun function from pushing to percussing. The pressure switch 164 controls the main valve 142 through a hammer board 210 and solenoid 218 (described in relation to FIG. 10).

Once in the percussing function, hydraulic fluid is then directed through the line 166 and the line 168 through flow control valve 170 and relief valve 172, which maintain hammer pressure at a maximum of approximately 1800 psi, and ultimately to the hydraulic impact hammer 54. The line 174, which branches from the line 166, includes flow control valve 176 and relief valve 178 which, through the line 180, maintain the downward pressure exerted by the piston of cylinder 71 upon the spike 12 through the anvil 76 at approximately 600 psi maximum in the percussing function. This feature prevents the machine 10 from lifting off of the rail during spiking. The pressurization of the line 166 causes the operation of the hammer 54, as described above in relation to FIG. 7. Either relief valve 172 or 178 direct fluid flow to tank 182 when pressure in the lines 168 and 174, respectively, exceeds a variable predetermined level, such as 600 psi.

When the gun 40 is to be raised, the spindle 152 is moved to the left, to the cross port position, wherein the rod end 158 is pressurized and the blind end 160 is drained to tank 182. The line 184, connected to the valve 148, is connected to the conventional machine travel circuit 186 which controls the movement of the machine 10 along the rails 18, and the conventional nipper control circuit 188, which grips the ties 14 during the spike driving operation to assist the gripping assembly 52 in holding the tie 14 up against the rails 18 while pushing the spike 12.

Figure 10:
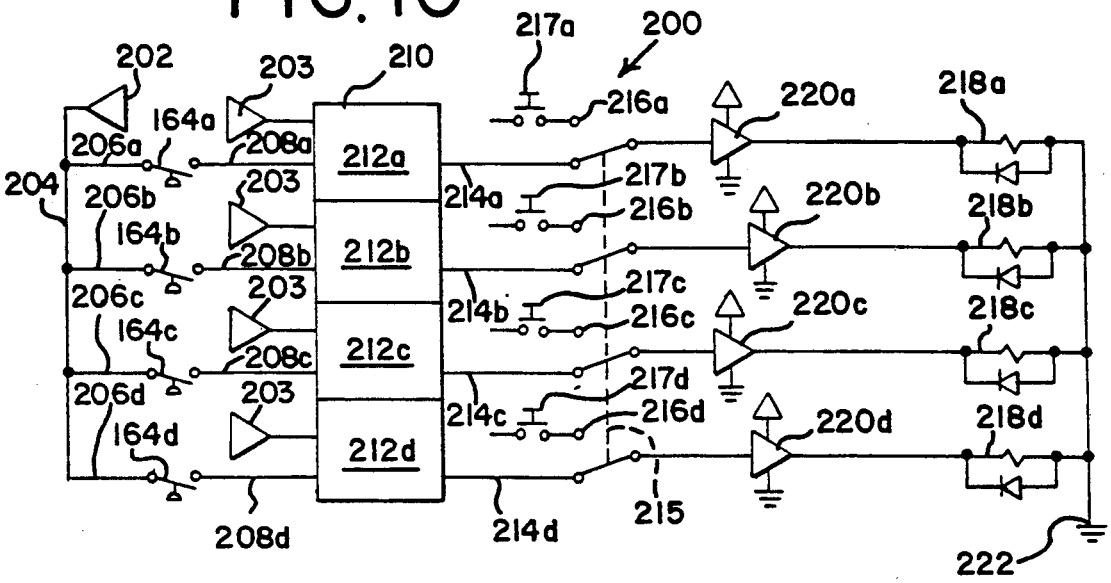
FIG. 10 is a schematic of the logic circuit of the present spike driving assembly.

Referring now to FIG. 10, the logic schematic for the circuitry operating the push/percussive functions of the present machine 10 is depicted. The depicted logic circuit, generally designated 200, is designed to control four guns 40 of the preferred system on the machine 10. Generally, the circuit 200 provides the operator of the machine 10 with the option of either an automatic or a manual spike driving mode. In the automatic mode, the spike is pushed until a specified pressure loading is encountered, at which time the machine automatically converts to percussing. In the manual mode, the operator selects whether to exclusively push or percuss the spike, and when, if ever, to switch between the two functions.

In the circuit 200, electric current is obtained through the operation of the power source 24 and is introduced at connection 202, and also at connection 203. A trunk line 204 provides current to the variable pressure switches 164, which have been designated 164*a*, 164*b*, 164*c*, and 164*d*, through branch lines 206*a*, 206*b*, 206*c*, 206*d*. The open terminals of the switches 164 are each connected by corresponding lines 208*a*, 208*b*, 208*c*, 208*d* to a corresponding module of a hammer board 210.

The hammer board 210 is designed to soften the cessation of the percussion function, which if undampened, will tend to cause the machine 10 to "buck" once the spike 12 has been completely driven into the tie 14. More specifically, a characteristic of the hammer main valve 142 and the driving valve 148 is that after a spike is driven and the appropriate control joystick trigger is released, both valves are shut off or closed. However, the hammer main valve 142 shuts off faster, causing full system pressure at the drive cylinder 71 for an "instant". The circuit of the hammer board 210 delays the shut off of the hammer main valve 142 to match the shut off speed of the driving valve 148, to eliminate "bucking" of the machine.

The modules of the hammer board 210 are identical and are designated 212*a*, 212*b*, 212*c* and 212*d*. The electrical schematic of a sample module 212 is depicted in FIG. 11 and will be described below.

The hammer board outputs are designated 214*a*, 214*b*, 214*c*, 214*d* and are each connected to a four-pole, two-position selector switch 215. In the position depicted, the selector switch 215 allows automatic mode operation. When the switch 215 is actuated to the alternate position, the machine 10 is set for manual operation, with the capability of operator override from the push function to the percussive function override through joystick input at contact points 216*a*, 216*b*, 216*c*, 216*d*, when selector switch 215 is in the second position (not shown). When actuated, switches 217*a*, 217*b*, 217*c*, 217*d*, mounted on the joystick 28, energize a corresponding solenoid 218*a–d* through a respective driver 220*a–d* to actuate the hammer main valve 142 to begin percussing. The specific type of switch employed at 217*a–d* is not critical, as long as the considerations of reliability, durability and operator comfort are addressed. The circuit 200 is grounded at 222.

Figure 11:
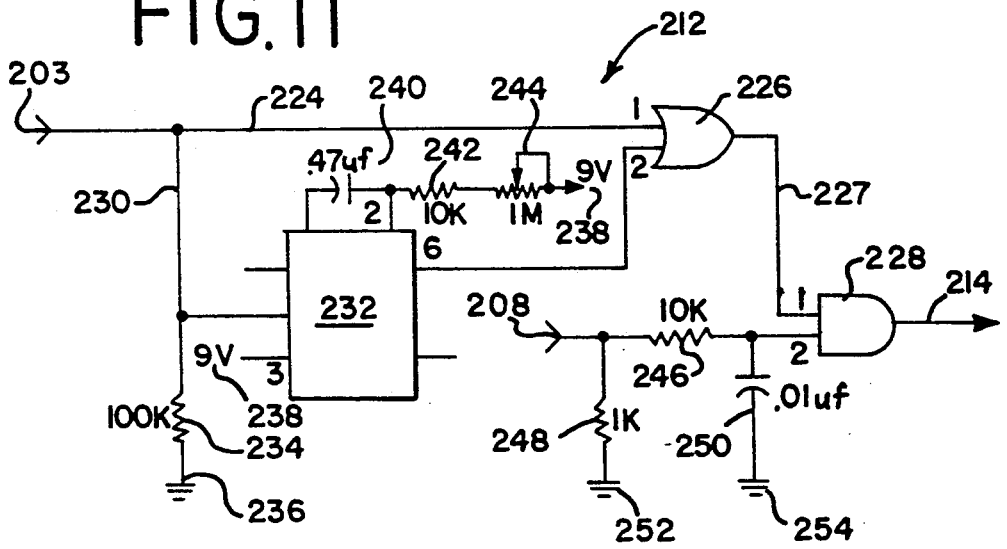
FIG. 11 is a schematic of a portion of the hammer board of FIG. 10.

Referring now to FIG. 11, the electrical schematic of a sample hammer board module 212 is depicted. The module 212 is activated by turning off the driver signal at 203 which is located on the control joystick 28. Once activated, the module 212 delays the shutoff of power to the gun 40 so that the hammer 54 stops percussing after the cylinder 71 stops pushing. Current flows along line 224 to terminal 1 of a quad 2-input OR buffered B Series gate 226. A suitable OR gate is manufactured by National Semiconductor Corporation, Santa Clara, Calif. as part no. CD4071BM/CD4071BC. From the OR gate 226, the current flows through line 227 to terminal 1 of a quad 2-input AND buffered B Series gate 228. A suitable AND gate is manufactured by National Semiconductor Corporation as part no. CD4081BM/CD4081BC. The output of the AND gate 228 is connected to the corresponding hammer board output 214*a–d*, and eventually to the corresponding spiker gun 40.

The incoming power line 224 is also connected by line 230 to a dual precision monostable multivibrator 232, such as National Semiconductor Corporation part no. CD4538BM/CD4538BC. The line 230 is also connected to 100K resistor 234 and is grounded at 236. A buffering power supply is provided to the multivibrator 232 at terminal 3 by a 9-volt power source 238. A 0.47 μf capacitor 240 is connected between terminals 1 and 2 of the multivibrator 232, and is also preferably connected to a 10K resistor 242, a 1M variable resistor 244, and the 9-volt power source 238. Terminal 6 of the multivibrator 232 is connected to the input terminal 2 of the OR gate 226.

The line 208 connected to the open terminal of the pressure switch 164 is connected to the input terminal 2 of the AND gate 228 through a 10K resistor 246, a 1K resistor 248, and a 0.01 μf capacitor 250. The resistor 248 and the capacitor 250 are grounded, respectively, at 252 and 254.

Depending on position of selector switch 215, either the manual or the automatic spike driving mode is initiated. Currently, two preferred operating modes available through actuation of the switch 215 are configured as follows:

1.) Manual mode, or pushing with manual percussive option. This mode is selected by selector switch 215 prior to beginning the spiking operation. In this mode, spikes 12 are typically pushed in all the time, however, the operator can manually override the pushing function and go into the percussive function by pushing one of the switches 217*a–d* on the control joystick 28. The percussive action will continue until the operator releases the switch 217. In this manner, the spike 12 may be driven exclusively by percussing if the operator so desires.

2.) Automatic mode. This mode is selected by actuating selector switch 215 into the position indicated in FIG. 10. In this mode, spike pushing occurs until the anvil 76 encounters sufficient resistance to raise pressure in the blind end 160 of the cylinder 71 to actuate the preset, adjustable pressure switch 164. The pressure may increase more rapidly if bent spikes or hardwood ties are encountered. The switch 164 trips automatically, initiating percussive spiking. It is contemplated that the setting of the pressure switch 164 can be varied to change the point at which the pushing function changes to the percussive function. Thus, at a low pressure setting, the machine 10 will percuss with minimal spike resistance. A high pressure setting will require higher spike resistance before percussing action is automatically initiated.

Since the push function and percussive function are separate actions, many different combinations of these actions are possible and are contemplated in the present machine, depending on the particular spike driving application. One such alternate combination is that in the manual mode selected by the switch 215, the percussive function is performed until overridden manually to change to the pushing function.

In operation, the operator, having already clamped the frame 20 to the rails 18 using the gripping assembly 52 and the nipper control circuit 188, actuates the control joystick 28 to manipulate the spiker gun 40 while in the ready position (best seen in FIG. 5) until the gun is directly over a designated hole 44 in a tie plate 16 through which it is desired to drive a spike 12 into the corresponding tie 14. A trigger on the control joystick 28 is then actuated to initiate spiking.

When the spike 12 has been driven almost all the way home, the operator releases the appropriate actuator on the control joystick 28 switch to cut signal input to the hammer board 210. This cessation of signal activates the module circuit depicted in FIG. 11, which delays shut off of the hammer main valve 142 to eliminate high pressure to the drive cylinder 71. Specifically, the signal to solenoid 218 is delayed by the action of the multivibrator 232, the capacitors 240, 250 and the 9-volt power source 238 sending time delayed turnoff signals to the solenoid after the power to the main circuit 200 has been cut off through the action of the joystick 28.

Once the spike driving operation is complete, whether in automatic or manual modes, the gun 40 is slidably elevated upon the carriage shafts 60 until an "up" proximity switch 256 (best seen in FIGS. 2–5) is triggered. The switch 256 is mounted to a vertical member 258 on the frame 20 near the carriage shafts, and is connected to the flow control a driving valve 148 to pressurize the hydraulic cylinder 162 to stop the upward travel of the gun 40. In this position, the gun 40 is sufficiently elevated to provide clearance for a spike to be fed from the spike magazine 98 to the gripper jaws 92. Upon pulling the appropriate control joystick trigger to a first detente, the gun 40 is sent downward until a second, "ready" proximity switch 260 is triggered. The gun 40 is then held at the ready position (best seen in FIG. 5) until the operator spots the spike 12 over the hole 44 in the tie plate 16 and pulls the trigger the rest of the way for driving.

Thus, the present spike driving machine 10 features the dual capabilities of push and percussive spike driving functions, and employs the major advantages of both, which for the most part compensate for the disadvantages of each function taken alone. The resulting spiker retains the high speed and generally quiet operation of a pusher, while drawing on the added power available from the percussive function when increased sensed hydraulic pressure levels or operator input dictates.

While a particular embodiment of the spike driving machine having push and percussive spike driving functions of the invention has been shown and described, it will be appreciated by those skilled in the art that changes and modifications may be made thereto without departing from the invention in its broader aspects and as set forth in the following claims.

What is claimed is:

1. A machine for performing an operation on spikes of a railroad track having a plurality of ties, comprising:

a frame having a plurality of wheels for rotatably engaging the railroad track;

drive means for driving said frame along the track; and spike driving means movably disposed relative to said frame for gripping spikes and driving gripped spikes into the ties, said spike driving means including spike pushing means for performing a spike pushing function and spike percussive means for performing a spike percussive function, said spike driving means being configured for driving the spike completely into the tie using selected application of said spike pushing function and said spike percussive function;

wherein said spike driving means is configured for performing one of said percussive function only, said pushing function only, and said pushing and percussive function only.

2. The machine as defined in claim 1 further including control means connected to said spike driving means for controlling the driving of the spikes, said control means adapted for selective operation of said pushing function and said percussive function.

3. The machine as defined in claim 2 wherein said control means is provided with switch means for actuation between a first position designating an automatic mode and a second position designating a manual mode.

4. The machine as defined in claim 3 wherein said control means is configured so that when said switch means is actuated to said first position, said spike driving means operates under a first of said functions until a specified pressure-induced signal is generated by said control means, said pressure-induced signal changing the operation of said spike driving means from said first function to a second of said functions.

5. The machine as defined in claim 4 wherein said first function is said pushing function, and said second function is said percussive function.

6. The machine is defined in claim 3 wherein said control means includes manual override means for selectively changing the function of said spike driving means from a first of said functions to a second of said functions.

7. The machine as defined in claim 6 wherein said first function is said pushing function and said second function is said percussive function.

8. The machine as defined in claim 2 wherein said control means includes means for dampering the impact of said percussive function as the spike is completely driven into the tie, said dampening means being configured to emit a modified signal to said spike driving means for reducing power to said spike driving means.

9. The machine as defined in claim 8 wherein said spike driving means includes at least one spike driving hammer, and said means for dampening includes a hammer board with a module for each said hammer, each said module configured for emitting said modified signal to said hammer after power to said board has been cut off.

10. The machine as defined in claim 9 wherein said control means includes a hammer main valve and a drive valve, and each said hammer module is configured to coordinate the closing of said hammer main valve with the closing of said drive valve.

11. The machine as defined in claim 1 wherein said spike driving means includes at least one spike driver gun having a hydraulic impact hammer.

12. The machine as defined in claim 11 wherein upon the driving of a spike into the tie, said control means is contructed and arranged to raise said gun a specified distance above the tie so as to permit a subsequent spike to be engaged by said gun for driving, and then to lower said gun to a ready position to begin driving of the spike.

13. The machine as defined in claim 12 wherein said control means includes a first proximity switch for determining an uppermost position of said gun and a second proximity switch for determining said ready position of said gun.

14. The machine as defined in claim 11 wherein said spike driver gun includes an anvil having a spike engagement end.

15. The machine as defined in claim 14 wherein said spike engagement end is configured to conform to the head of a spike.

16. The machine as defined in claim 15 wherein said spike engagement end is concave in shape.

17. The machine as defined in claim 11 including at least a pair of spike driver guns associated with each rail of the track, said at least one pair of guns being releasably secured to each other for stabilized movement relative to said frame.

18. The machine as defined in claim 17 wherein said guns are secured to each other by a pair of C-shaped members releasably fixed to each other in back-to-back, horizontally offset relationship.

19. A machine for driving spikes into ties of a railroad track, comprising:

a frame having a plurality of wheels for rotatably engaging the railroad track;

drive means for driving said frame along the track;

spike driving means movably disposed relative to said frame for gripping spikes and driving gripped spikes into the ties, said spike driving means including spike pushing means for performing a spike pushing function and spike percussive means for performing a spike percussive function, said spike driving means being configured for driving the spike completely into the tie using selected applications of said spike pushing function and said spike percussive function, said spike driving means being configured for performing one of said percussive function only, said pushing function only, and said pushing and percussive function only; and control means connected to said spike driving means for controlling the driving of the spikes, said control means adapted for selective operation of said pushing function and said percussive function between an automatic mode and a manual mode so that, in said automatic mode, responsive to a first signal, said spike driving means in said pushing function pushes the spike a specified distance into the tie, and responsive to a second signal, said spike driving means is actuated to said percussive function to complete the driving of the spike into the tie, and in said manual mode, said control means being configured to provide for manual selective actuation between said pushing function and said percussive function.

20. The machine as defined in claim 19 wherein said control means includes means for dampening the impact of said percussive function as the spike is completely driven into the tie, said dampening means being configured to emit a modified signal to said spike driving means for reducing power to said spike driving means.

21. The machine as defined in claim 19 wherein upon the driving of a spike into the tie, said control means is constructed and arranged to raise said gun a specified distance above the tie so as to permit a subsequent spike to be engaged by said gun for driving, and then to lower said gun to a ready position to begin driving of the spike.

22. The machine as defined in claim 19 wherein said spike driving means includes at least one spike driver gun having a hydraulic impact hammer.

23. A method for driving spikes into the ties of a railroad track, comprising:

providing a spike to a spike driving means for driving spikes, said spike driving means including spike pushing means for pushing spikes completely into the tie and spike percussive means for percussing spikes completely into the tie, said spike driving means being configured for performing one of a percussive function only, a pushing function only, and a pushing and percussive function only;

gripping the spike on said spike driving means;

actuating said spike driving means to perform a first of said functions to the spike; and signalling said spike driving means to cease performing said first function and begin performing a second of said functions to the spike for driving the spike into the tie.

24. The method of claim 23 wherein said first function is a pushing function, and said second function is a percussive function.

25. The method of claim 23 further including raising said spike driving means upon the completion of the driving operation to receive a second spike for driving.

26. The method of claim 23 further comprising providing a spike driver gun having a hydraulic impact hammer for said spike driving means.

* * * * *